United States Patent [19]

Blake

[11] 4,317,567

[45] Mar. 2, 1982

[54] INSTRUCTIONAL AND/OR TEACHING DEVICES FOR BALL GAMES

[76] Inventor: Minden V. Blake, Virginia Water, Surrey GU25 4PH, England

[21] Appl. No.: 79,178

[22] Filed: Sep. 26, 1979

[30] Foreign Application Priority Data

Sep. 29, 1978 [GB] United Kingdom ..... 38794/78

[51] Int. Cl.[3] ..... A63B 69/36

[52] U.S. Cl. ..... 273/26 B; 273/186 C

[58] Field of Search ..... 273/26 R, 26 B, 29 A, 273/186 R, 186 A, 186 C, 183 D, 72 R, 81 R, 81.2

[56] References Cited

U.S. PATENT DOCUMENTS

| | | | |
|---|---|---|---|
| 2,772,887 | 12/1956 | Blake | 273/26 B |
| 3,113,782 | 12/1963 | Guier | 273/26 B |
| 3,136,546 | 6/1964 | Conolly | 273/26 B |
| 3,173,688 | 3/1965 | Green | 273/72 R |
| 3,897,058 | 7/1975 | Koch | 273/72 R |
| 3,931,968 | 1/1976 | Hedberg | 273/81.2 |
| 4,027,879 | 6/1977 | Wright | 273/29 A |

*Primary Examiner*—Richard C. Pinkham
*Assistant Examiner*—T. Brown
*Attorney, Agent, or Firm*—Cushman, Darby & Cushman

[57] ABSTRACT

A device for enabling a player to practice swinging a club, racket, bat or the like comprises two telescopically engaged parts, one having a handle or grip and the other simulating or carrying the head portion of the club. A release mechanism is provided including an axially movable weight which prevents relative axial movement of the two telescopically engaged parts until centrifugal force induced by the swing of the device exceeds a predetermined value. The weight is spring urged into position locking the two parts together and means are provided to adjust the compression of the spring.

8 Claims, 2 Drawing Figures

INSTRUCTIONAL AND/OR TEACHING DEVICES FOR BALL GAMES

Figure 1:
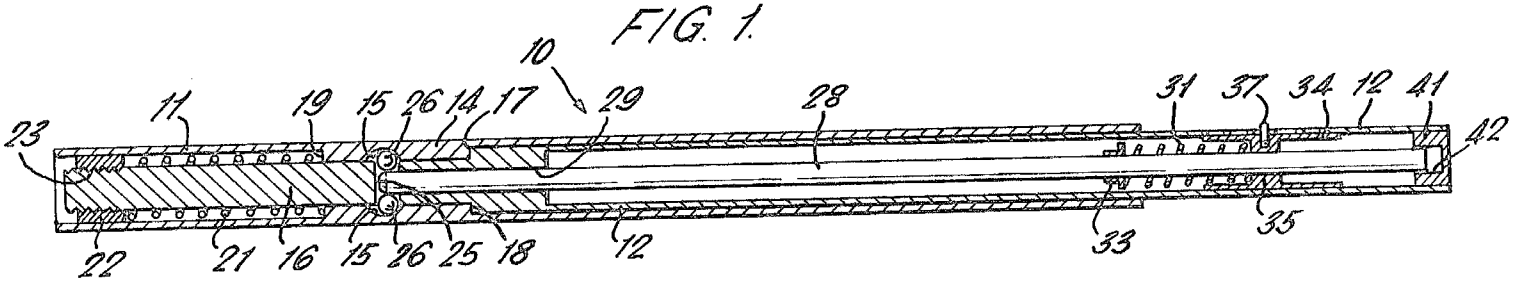

This invention relates to instructional and practice devices for teaching and maintaining the correct arm and body movements in ball games employing clubs, bats, rackets or the like.

While this invention may be applied to many ball games, it is particularly useful in learning and practicing sports such as golf, tennis and baseball. In these sports, the action of striking the ball is achieved by a stroke or swing which consists of a steady acceleration of the striking or head part of the club, racket or bat towards the ball followed by a rapid acceleration at the part of the swing immediately prior to contact with the ball and a relaxed followthrough. Ideally the point of maximum angular velocity should be when the striking part of the club, racket or bat is in contact with the ball and, in order to achieve this, the body, arms and wrists of the player must be co-ordinated in an efficient swing pattern. To achieve this requires practice. It is not desirable for this practice to take place by swinging a normal club, racket, bat or the like without hitting anything as the mental impression so formed is entirely different from a proper stroke because there is no shock of impact of brace against. Equally it is very often not possible to practice by hitting a ball because of the space required. It is therefore desirable in a practice device to provide at the normal point of impact a resistance to the hands which gives the feel of hitting a ball. This is most conveniently achieved by arranging for the centre of gravity of the device to move away from the fulcrum of the swing at the hit position.

In previous inventions this has been obtained by a weight change in the head of the club or racquet. This is by having a release mechanism operated by centrifugal force which lets a weight in the head slide out or swing out and forward within the head.

This invention provides a device for enabling a player to practice swinging a club, racket, bat or the like comprising an elongate member including two telescopically engaged parts, one said part having a portion which is gripped by the player at one end, and a release mechanism for preventing relative axial movement of the two parts of the member until it is released by centrifugal force, induced by the swing of the member, exceeding a predetermined value.

In this device, the head portion of the club, racquet or bat which is said other part is permitted to move relative to the grip. That is when the club, racquet or bat is swung and a certain angular acceleration is obtained a release mechanism lets the main body of the instrument slide out relative to the grip. Whereas previously it was difficult to get sufficient weight movement to give the proper reaction on the hands to simulate a hit, now this can be obtained by the smallest movement of the mass of the club racquet or bat in the handle or grip.

The device consists of the main body of the club, bat or racquet with an elongate member which fits into the grip and which can move axially a restricted amount when released by centrifugal force operating on a small weight.

Preferably means are provided for adjusting the predetermined view of centrifugal force at which the weight is released. The restricting means may be a spring in which case the adjusting means may comprise means for compressing the spring.

This device simulates the feel of hitting a ball by permitting the centre of gravity to move axially away from the member which is held in the hands. The movement is arranged so that the reaction on the hands is similar to the reaction experienced when a normal club racket or bat is in contact with a ball.

The weight is preferably in the form of a rod slidably housed within the elongate member.

Figure 2:
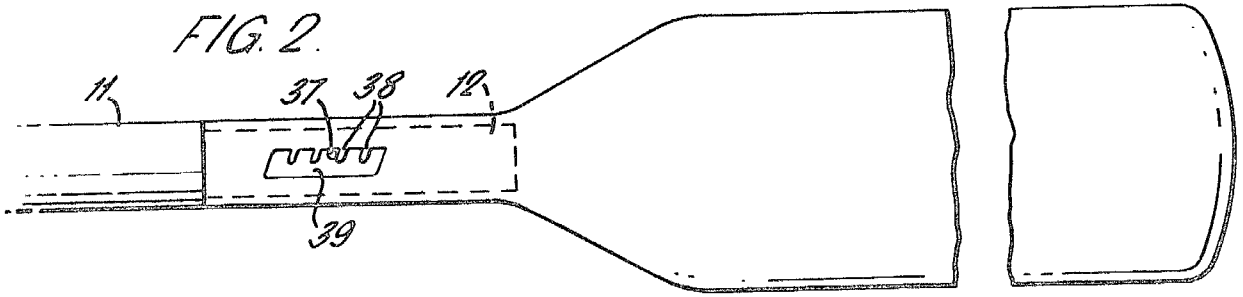

Further features and advantages of the invention will be apparent from the following description, by way of example, of a preferred embodiment of a swing practice device, the description being read with reference to the accompanying drawings, in which:

FIG. 1 is a longitudinal section through a swing practice device according to the invention, certain parts being omitted for clarity, and FIG. 2 is an external view of part of the device of FIG. 1.

Referring to the drawings, a swing practice device 10 is the handle or grip portion of a ball striking implement such as a golf club, tennis racket, baseball bat or the like.

The device 10 comprises a tubular housing consisting of two telescopically engaged tubular parts 11, 12. The outer tubular part 11 is of circular cross-section and includes a restricted bore portion 14 having indentations 15 formed in its internal surface. The inner tubular part 12 is a sliding fit within part 11 and includes a cylindrical extension 16 which projects through the restricted bore portion 14, the shoulder 17 formed between the tubular portion of part 12 and the extension 16 engaging one annular end face 18 of the bore portion 14.

The extension 16 includes a transverse bore 25, which is aligned with the indentations 15 when the parts 11, 12 are assembled as shown in FIG. 1 and in which are located two steel balls 26. The parts 11, 12 are retained in assembled relation by the 2 balls 26. A stiff coil spring 21 located around the extension 16 and between the other annular end face 19 of the bore portion 14 and a nut 22 screwed on to a threaded end portion 23 of extension 16 will return the parts 11, 12 to the assembled position after the device has been operated.

A weight in the form of a rod 28 extends through the tubular part 12 co-axially therewith and has one end slidably housed in a bore 29 formed in the extension 16 and communicating with transverse bore 25.

The rod 28 is movable axially of the part 12 in and out of bore 29 but its movement is restricted by a spring 31. The spring 31 surrounds the rod 28 and is located between an annular stop 33 fixed to the rod 28 and a movable stop 34 in the form of a sleeve having an internal annular flange 35 abutted by one end of the spring 31. The stop 34 is lockable in a number of positions by means of a pin 37 screwed into the stop 34 and engaging one of a series of abutments 38 formed in an axial slot 39 in the part 12.

The pin 37 projects through the slot 39 and may be manually moved along the slot into engagement with the different abutments 38 to adjust the preset compression of spring 31.

The possible axial movement of rod 28 is limited by a cylindrical stop 41 which is retained in the open end of part 12 by a grub screw or similar fixing and includes a blind bore 42 into which the free end of rod 28 projects. The length of the blind bore 42 is selected to permit a limited amount of axial movement of the rod 28 so that when the rod moves into its extreme right-hand position as viewed in FIG. 1, the balls 26 which normally rest in the indentations 15 are permitted to roll into the transverse bore 25 behind the end of rod 28 but are not permitted to enter the bore 29.

When the device 10 is fitted into a ball striking implement, it is arranged so that the part 11 lies within, or forms, the handle or grip part of the implement and the head or striking part of the implement extends from the right hand end of part 12 as viewed in FIG. 1, a slot being provided in the implement to permit access to pin 37. It will be appreciated that the device 10 may thus be incorporated in the shaft of a golf club or tennis racket, a baseball bat or any other like implement. By way of example, FIG. 2 illustrated the device as part of a baseball bat.

The use of the device for practising swinging such clubs, rackets, bats and the like is as follows. The implement is gripped by its handle portion by the player and swung in the usual manner appropriate to the particular game being practised. As the implement is swung, its angular velocity induces a force on the rod 28 acting outwarddly of the arc of swing, that is to say to the right as viewed in FIG. 1. When this force reaches a value greater than the force of spring 31, the rod 28 moves to the right as viewed in FIG. 1, and the balls 26 which are holding part 12 against the centrifugal acting on it, are forced into the transverse bore 25.

This enables the main body of the instrument 12 under the centrifugal force of the swing to slide in the grip 11 and compress the spring 21. The centre of gravity of the implement moves outwardly of the centre of swing thus producing an angular retardation of the implement which sumulates the "feel" of striking a ball. The strong spring 21 will return the main body of the club to its original position as soon as the centrifugal force lessens and gives the feeling of the ball leaving the instrument.

When the implement is returned to its rest position by the player, the force of spring 31 on rod 28 forces the balls 26 apart (the end rod 28 being chamfered for this purpose) and the rod returns to its rest position, illustrated in FIG. 1.

In order to practice a swing effectively, it will be appreciated that it is important for the rod 28 to move outwardly at the moment when a ball would be struck. In order to achieve this, the spring force of spring 31 is adjusted by means of pin 27 to suit the strength and capability of the individual player.

I claim:

1. A device for enabling a player to practice swinging a club, racket, bat or the like comprising an elongate member including two telescopically engaged parts, one said part having a portion which is gripped by the player at one end, and a release mechanism for preventing relative axial movement of the two parts of the member until it is released by centrifugal force, induced by the swing of the member, exceeding a predetermined value, said release mechanism including a weight within the elongate member, and movable axially of the member, means for restricting the movement of the weight until it is released by centrifugal force exceeding the said predetermined value, and means locking the two telescopically engaged parts together, said locking means being released by axial movement of the weight, the locking means comprising two balls which rest in recesses in the outer one of said telescopically engaged parts to lock said parts together and which are movable within a transverse bore in the inner one of said parts to release the parts, the weight comprising a rod having an end resting between the balls to urge them into the recesses whereby axial movement of the rod releases the balls.

2. A device for enabling a player to practice swinging a club, racket, bat or the like comprising an elongate member including two telescopically engaged parts, a first of said parts having a portion which is gripped by the player at one end and the second of said parts having a striking portion at its end remote from the portion of said first part which is gripped, said first and second parts being relatively axially movable between a first rest position and a second position, spring means biasing said first and second parts toward said first position, a release mechanism for preventing relative axial movement of the two parts from the first position to the second position until said mechanism is released by centrifugal force induced by the swing of the member exceeding a predetermined value, whereupon said first and second parts move by centrifugal force to said second position against the biasing action of said spring means, said spring means being operable upon reduction of the centrifugal force to return said parts from said second position to said first position.

3. A device as in claim 2 wherein the release mechanism includes a weight mounted within the elongate member and movable axially of the member, and means for restricting the movement of the weight until it is released by centrifugal force exceeding the said predetermined value.

4. A device as in claim 3 including means for adjusting the predetermined value of centrifugal force at which the weight is released.

5. A device as in claim 4 wherein the restricting means comprises a spring and wherein the adjusting means comprises means for compressing the spring.

6. A device as in claim 3 wherein the release mechanism further includes means locking the two telescopically engaged parts together, said means being released by axial movement of the weight.

7. A device as in claim 2 including means to limit the relative axial movement of the two telescopically engaged parts.

8. A device as in claim 7 wherein said limiting means comprises abutments on said members and a spring located between said abutments, said spring acting to return the parts to their rest position after operation of the device.

* * * * *